US008863948B2

(12) United States Patent
Ogawa et al.

(10) Patent No.: US 8,863,948 B2
(45) Date of Patent: Oct. 21, 2014

(54) DRUG STORAGE CONTAINER

(75) Inventors: Junichi Ogawa, Yamanashi (JP); Kouichi Tachikawa, Shizuoka (JP)

(73) Assignee: Terumo Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/007,772

(22) PCT Filed: Mar. 27, 2012

(86) PCT No.: PCT/JP2012/057909

§ 371 (c)(1),
(2), (4) Date: Sep. 26, 2013

(87) PCT Pub. No.: WO2012/133393

PCT Pub. Date: Oct. 4, 2012

(65) Prior Publication Data

US 2014/0014547 A1 Jan. 16, 2014

(30) Foreign Application Priority Data

Mar. 28, 2011 (JP) ..... 2011-069986

(51) Int. Cl.
*B65D 25/08* (2006.01)

(52) U.S. Cl.
USPC ..... 206/222

(58) Field of Classification Search
USPC ..... 206/219, 222, 220, 828
See application file for complete search history.

(56) References Cited

U.S. PATENT DOCUMENTS

| | | | | |
|---|---|---|---|---|
| 2,724,383 | A | 11/1955 | Lockhart | |
| 3,347,410 | A * | 10/1967 | Schwartzman | 222/80 |
| 3,872,867 | A * | 3/1975 | Killinger | 604/413 |
| 4,994,029 | A | 2/1991 | Rohrbough | |
| 5,071,034 | A * | 12/1991 | Corbiere | 222/80 |
| 5,569,191 | A | 10/1996 | Meyer | |
| 5,826,713 | A * | 10/1998 | Sunago et al. | 206/222 |
| 6,224,568 | B1 | 5/2001 | Morimoto et al. | |
| 8,051,884 | B2 * | 11/2011 | Reuter | 141/329 |
| 2013/0228481 | A1 * | 9/2013 | Nobbio | 206/219 |

FOREIGN PATENT DOCUMENTS

| | | |
|---|---|---|
| JP | 4-75539 | 7/1992 |
| JP | 4-75540 | 7/1992 |
| JP | 4-126545 | 11/1992 |
| JP | 2002-172151 | 6/2002 |
| JP | 2004-041568 | 2/2004 |
| JP | 2006-55452 | 3/2006 |

* cited by examiner

*Primary Examiner* — Jacob K Ackun

(74) *Attorney, Agent, or Firm* — Greenblum & Bernstein, P.L.C.

(57) ABSTRACT

A drug storage container includes: a first container; a second container that is disposed on the lower end side of the first container; a needle tube for making an internal space of the first container and an internal space of the second container communicate with each other; operating means for performing an operation of bringing the first container closer to the second container; a drug stored in the internal space; and a liquid stored in the internal space. In the drug storage container, with the first container and the second container brought closer to each other by the operating means, the internal space of the first container and the internal space of the second container are made to communicate with each other through the needle tube, and the volume of the internal space of the second container is reduced.

9 Claims, 11 Drawing Sheets

DRUG STORAGE CONTAINER

TECHNICAL FIELD

The present invention relates to a drug storage container.

BACKGROUND ART

In general, many drugs are stored in vials (drug storage containers) which are each sealed with a rubber stopper (see, for example, Patent Document 1).

In the case of taking a drug, for example, a powdery drug out of such a vial, an injection needle is attached to a distal end of a syringe in which a liquid for dissolution is stored, and the rubber stopper of the vial is punctured by the injection needle, to inject the liquid for dissolution into the vial. As a result, a dissolution liquid with the drug dissolved therein (hereinafter referred to as "a drug solution") is obtained. In the case of such a vial, however, the liquid for dissolution flowing out from the injection needle would vigorously drip down directly to the drug, resulting in foaming in the drug solution (generation of bubbles in the drug solution). Thus, at the time of sucking the drug solution from the vial by use of the syringe or the like, there may be problems that it is impossible to achieve accurate metering and that unevenness of concentration of the drug solution is generated.

Patent Document 1: Japanese Patent Laid-open No. 2006-55452

DISCLOSURE OF INVENTION

It is an object of the present invention to provide a drug storage container which ensures that at the time of mixing a liquid with a drug stored in the drug storage container, the drug and the liquid can be made homogeneous (uniform) easily and speedily, while preventing or restraining foaming from occurring in a drug solution obtained.

In order to attain the above object, according to the present invention, there is provided a drug storage container characterized by including:

a first container which includes a first container body including a first opening provided at an upper end, a second opening provided at a lower end, a first space having a variable volume, and a drug stored in the first space, a first seal member so provided as to close the first opening in a liquid-tight manner, and a second seal member for sealing the second opening;

a second container which is used while disposed on a lower side as compared with the first container, and wherein the second container includes a second container body including a third opening provided at an upper end, a second space having a variable volume, and a liquid stored in the second space, and a third seal member for sealing the third opening;

a hollow needle tube which is located between the first space and the second space, and wherein the hollow needle tube pierces through the second seal member and the third seal member to establish a communication between the first space and the second space when the first container and the second container are brought closer to each other; and a changing part which is provided inside the first space on an upper end side as compared with the second seal member, and wherein the changing part brings the first container and the second container closer to each other so as to make the first space and the second space communicate with each other through the needle tube and so as to reduce a volume of the second space, thereby changing a flow direction of the liquid so that the liquid discharged from the needle tube is not supplied directly to the drug when the liquid flows from the second space into the first space.

In addition, in the drug storage container of the present invention, preferably, the changing part changes the flow direction of the liquid into an orthogonal direction which is substantially orthogonal to a vertical direction.

Besides, in the drug storage container of the present invention, preferably, the changing part has a flow path formed along the orthogonal direction.

Further, in the drug storage container of the present invention, preferably, the flow path has a portion which is curved or bent spirally in a circumferential direction of the changing part.

In addition, in the drug storage container of the present invention, preferably, the first container body has a tubular trunk part, and the trunk part is so configured that at least a part thereof can be extended and contracted along a vertical direction, whereby the volume of the first space can be varied.

Besides, in the drug storage container of the present invention, preferably, the first container body has a tubular trunk part, and the first container has a gasket provided in the trunk part in a slidable manner, whereby the volume of the first space can be varied.

Further, in the drug storage container of the present invention, preferably, the second container body has a tubular trunk part, and the trunk part is so configured that at least a part thereof can be extended and contracted along a vertical direction, whereby the volume of the second space can be varied.

In addition, in the drug storage container of the present invention, preferably, the second container body has a tubular trunk part, and the second container has a gasket provided in the trunk part in a slidable manner, whereby the volume of the second space can be varied.

Besides, the drug storage container of the present invention, preferably, further includes operating means for performing an operation of bringing the first container closer to the second container.

Further, in the drug storage container of the present invention, preferably, the needle tube is provided with a sharp needle tip at an upper end thereof, and a lower end portion thereof is fixed to the second container.

In addition, in the drug storage container of the present invention, preferably, the flow path has a portion the width of which is enlarged along an outward direction.

BRIEF DESCRIPTION OF DRAWINGS

FIG. 1 is a longitudinal sectional view for sequentially illustrating a process of using a drug storage container (first embodiment) of the present invention.

FIG. 2 is a longitudinal sectional view for sequentially illustrating the process of using the drug storage container (first embodiment) of the present invention.

FIG. 3 is a longitudinal sectional view for sequentially illustrating the process of using the drug storage container (first embodiment) of the present invention.

FIG. 4 is a longitudinal sectional view for sequentially illustrating the process of using the drug storage container (first embodiment) of the present invention.

FIG. 5 is a perspective view (a view in a state of being inverted upside down) showing a configuration of a changing plate in the drug storage container shown in FIGS. 1 to 4.

FIG. 6 is a perspective view (a view in a state of being inverted upside down) showing another configuration example of a changing plate.

FIG. 7 is a longitudinal sectional view showing other configuration example of a changing part.

FIG. 8 is a longitudinal sectional view showing other configuration example of a changing part.

FIG. 9 is a longitudinal sectional view showing other configuration example of a changing part.

FIG. 10 is a longitudinal sectional view showing a drug storage container (second embodiment) of the present invention.

FIG. 11 is a longitudinal sectional view for sequentially illustrating a process of using a drug storage container (third embodiment) of the present invention.

FIG. 12 is a longitudinal sectional view for sequentially illustrating the process of using the drug storage container (third embodiment) of the present invention.

FIG. 13 is a longitudinal sectional view for sequentially illustrating the process of using the drug storage container (third embodiment) of the present invention.

BEST MODE FOR CARRYING OUT THE INVENTION

Now, a drug storage container according to the present invention will be described in detail below, based on preferred embodiments shown in the accompanying drawings.

First Embodiment

Figure 5:
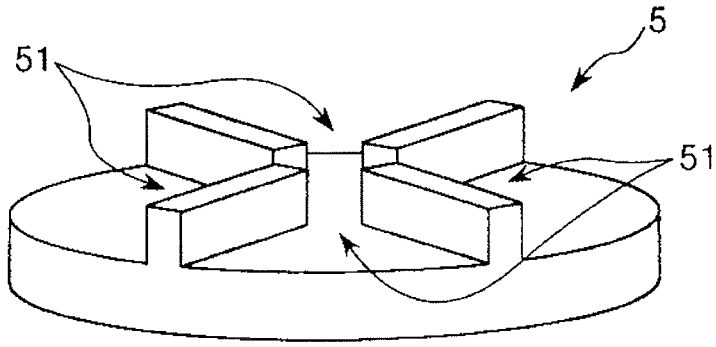
[FIG. 5]
Figure 6:
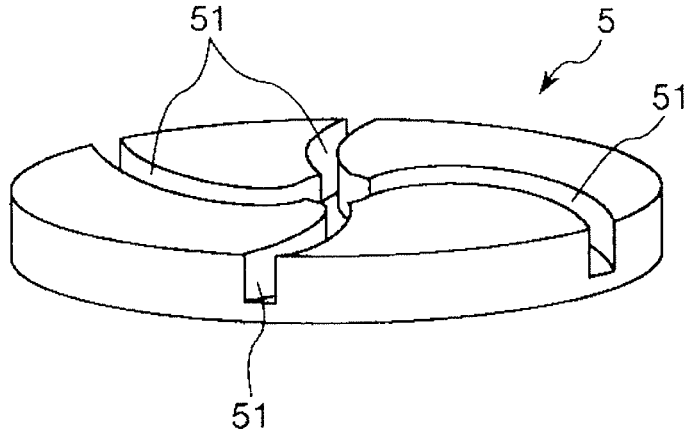
[FIG. 6]
Figure 7:
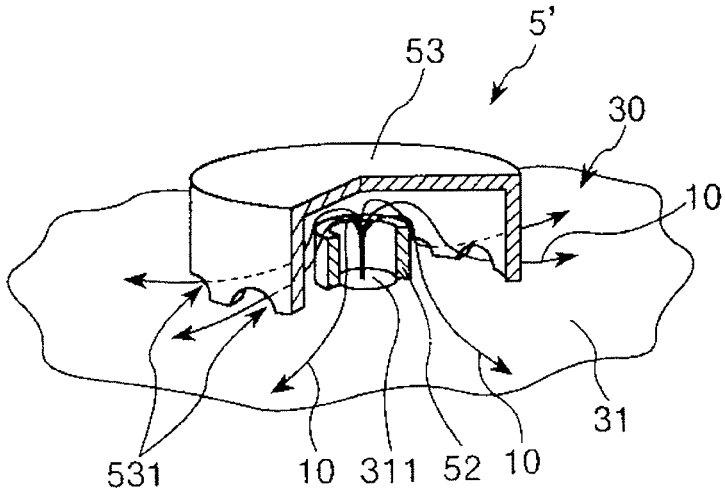
[FIG. 7]
Figure 8:
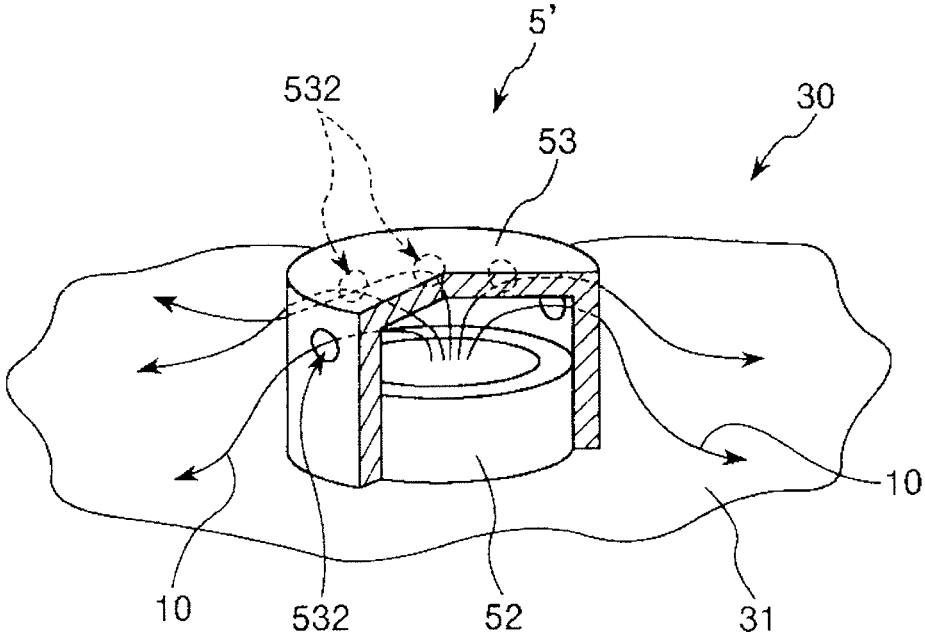
[FIG. 8]
Figure 9:
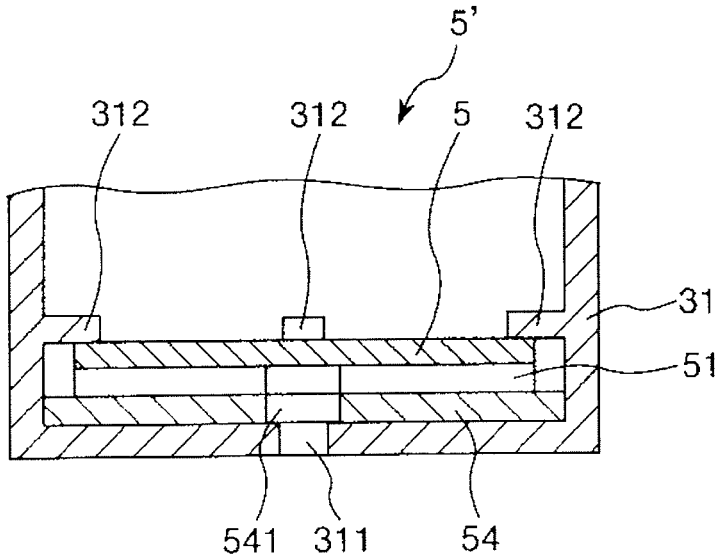
[FIG. 9]

Each of FIGS. 1 to 4 are a longitudinal sectional view for sequentially illustrating a process of using a drug storage container (first embodiment) of the present invention; FIG. 5 is a perspective view (a view in a state of being inverted upside down) showing a configuration of a changing plate in the drug storage container shown in FIGS. 1 to 4; FIG. 6 is a perspective view (a view in a state of being inverted upside down) showing another configuration example of a changing plate; and each of FIGS. 7 to 9 are longitudinal a sectional view showing other configuration example of a changing part.

Incidentally, in the following, for convenience of description, the upper side in each of FIGS. 1 to 4 and FIGS. 7 to 9 (and in each of FIGS. 10 to 13, as well) will be referred to as "upper" or "upper side", while the lower side in each of the figures will be referred to as "lower" or "lower side", the upper side in each of FIGS. 5 and 6 will be referred to as "lower" or "lower side", and the lower side in each of these figures will be referred to as "upper" or "upper side".

Figure 1:
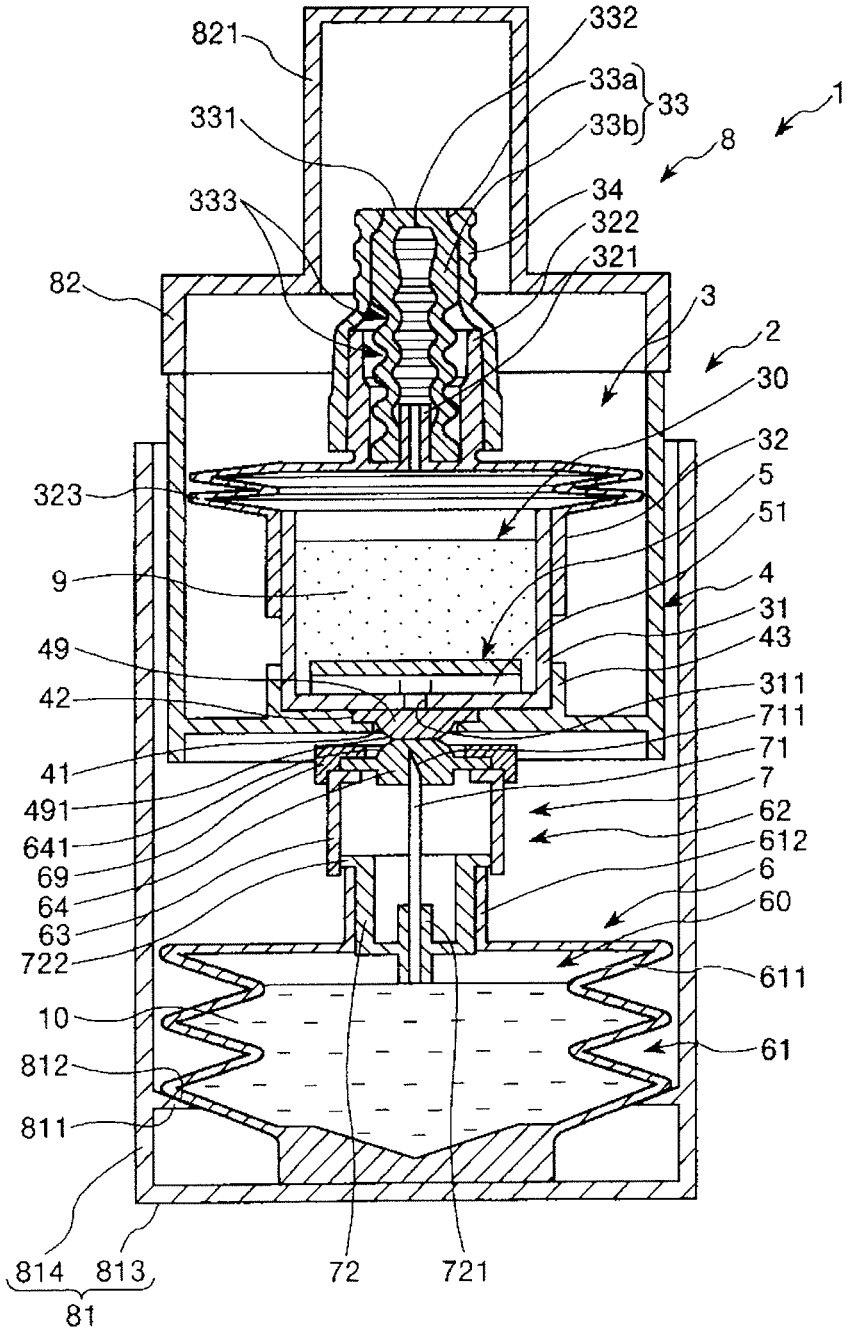
[FIG. 1]

A drug storage container 1 shown in FIG. 1 includes: a first container 2; a second container 6 used while disposed on a lower end side relative to the first container 2; communicating means 7 for providing communication between an inside of the first container 2 and an inside of the second container 6; operating means 8 for performing an operation of bringing the first container 2 closer to the second container 6; a drug 9 stored in the inside of the first container 2; and a liquid 10 stored in the inside of the second container 6.

In the drug storage container 1 as above, an operation of the operating means 8 causes the communicating means 7 to provide the communication between the inside of the first container 2 and the inside of the second container 6, whereby the liquid 10 can be made to flow from the inside of the second container 6 into the inside of the first container 2 through the communicating means 7, to be mixed with the drug 9.

Figure 4:
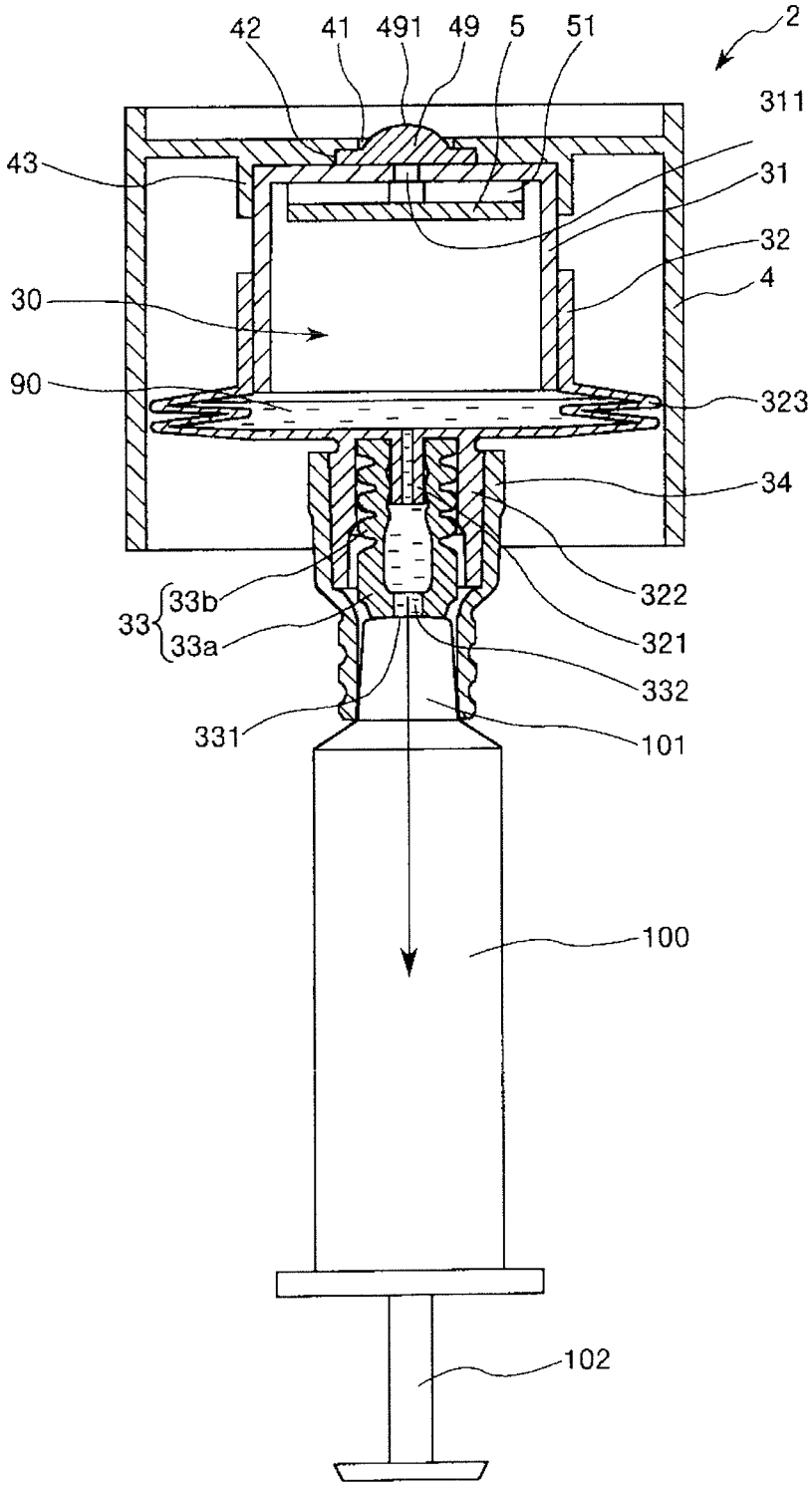
[FIG. 4]

A drug solution 90 obtained by the mixing of the drug 9 and the liquid 10 can be dispensed into a syringe 100 by connecting the syringe 100 to the drug storage container 1, as shown in FIG. 4, for example.

Now, components of the drug storage container 1 will be sequentially described below.

The first container 2 includes: a first container body including an inner container 3 storing the drug 9 therein and an outer container 4 provided on an outside of the inner container 3; and a changing plate (changing part) 5 provided inside the inner container 3.

The inner container 3 includes: a lower member 31 having a bottomed tube-like shape; and an upper member 32 having a bottomed tube-like shape and fixed to the lower member 31 so as to cover an upper-end opening of the lower member 31. The lower member 31 and the upper member 32 define an internal space (first space) 30, and the drug 9 is stored in the internal space 30.

A bottom portion of the lower member 31 is formed with a through-hole 311 in a central part thereof. A needle tube 71 which will be described later is inserted and passed in the through-hole 311.

In addition, at an upper end surface of the bottom portion of the lower member 31, the changing plate 5 is provided so as to cover the through-hole 311. The configuration, operations and effects of this changing plate 5 will be described later.

A bottom portion of the upper member 32 is located on an upper side of a trunk part 323. At an upper end surface of the bottom portion, a mouth part 321 projecting upward is provided at a central part of the upper end surface, and a circular tube-like support part 322 is provided concentrically with the mouth part 321. A lumen of the mouth part 321 communicates with the internal space 30.

The trunk part 323 of this upper member 32 has its upper-end-side portion in a bellows-like form; thus, the trunk part 323 is so configured that it can be extended and contracted in the vertical direction. In other words, in the present embodiment, a volume of the internal space 30 is increased/decreased (can be varied) by the expansion/contraction of the trunk part 323.

Besides, between the mouth part 321 and the support part 322 of the upper member 32, there is mounted a valve element 33 as a first seal member for closing the mouth part 321 in a liquid-tight manner.

The valve element 33 includes a circular disk-like head part 33*a*, and a hollow cylindrical trunk part 33*b* formed on a lower side of the head part 33*a* integrally with the head part 33*a*, and is wholly formed of an elastic material. Incidentally, the valve element 33 may be the same as or similar to a second seal member 49 and a third seal member 64 which will be described later.

The head part 33*a* is formed with an open/close port 332 which opens when necessary. The open/close port 332 is composed of a straight line segment-shaped slit formed in a central portion of the head part 33*a* so as to penetrate the head part 33*a*.

When the valve element 33 is in a natural state, namely, in the state of being not pressed by a mouth part 101 of the syringe 100, for example, the open/close port 332 is closed by the elasticity of the valve element 33 itself. In a connected state shown in FIG. 4, on the other hand, the open/close port 332 is opened by deformation of the head part 33*a* and portions surrounding it. Through the open/close part 332 thus opened, the inside of the syringe 100 and the internal space 30 communicate with each other.

Incidentally, the open/close port 332 is not restricted to the configuration shown in the drawings. For instance, a configuration may be adopted in which a slit reaching only a surface on one side of the head part 33*a* and a slit reaching only a surface on the other side of the head part 33*a* are formed, and the slits intersect partly with each other in the inside of the head part 33*a*.

An outer circumferential surface of the trunk part 33*b* of the valve element 33 is formed with a plurality of ring-shaped recesses 333 at intervals along the axial direction. At the recesses 333, the trunk part 33*b* of the valve element 33 is reduced in wall thickness. This ensures that the whole part of the valve element 33 is easily deformable, so that the open/close port 332 can be opened more assuredly.

In addition, a top face 331 of the valve element 33 is a smooth surface. This ensures that dirt adhering to the top face 331 can be easily wiped away by use of, for example, a cotton ball impregnated with a disinfectant agent. Consequently, the drug storage container 1 can be maintained and controlled in a sanitary manner.

A material constituting the valve element 33 is not specifically restricted. Examples of the material which can be used include elastic materials such as various rubber materials such as a natural rubber, butyl rubber, isoprene rubber, butadiene rubber, styrene-butadiene rubber, isobutylene rubber, silicone rubbers, etc., various thermoplastic elastomers based on polyurethane, polyester, polyamide, olefin, styrene or the like, and mixtures of these materials.

On an outer circumference side of the valve element 33, there is disposed a cap 34 for fixing the valve element 33 to the upper member 32. The cap 34, composed of a tubular body, is fixed to the support part 322 of the upper member 32 by such a method as fitting, welding (thermal welding, high-frequency welding, ultrasonic welding, or the like), adhesion (adhesion with an adhesive or a solvent), etc.

In the internal space 30 of the first container 2 is stored the drug 9. The drug 9 may be either a liquid type or a powdery type. In the present embodiment, a freeze-dried powdery drug 9 is stored in the internal space 30.

The drug 9 may be any of those drugs which are ordinarily used as an injection. Examples of the drug which can be used as the drug 9 include protein drugs such as antibodies, etc., peptide drugs such as hormones, etc., nucleic acid drugs, cell drugs, blood preparations, vaccines for prevention of various infectious diseases, carcinostatic agents, anesthetic drugs, narcotics, antibiotics, steroid preparations, protease inhibitors, heparin, carbohydrate injections such as glucose, etc., electrolyte correction injections such as sodium chloride, potassium lactate, etc., vitamin preparations, fat emulsions, contrast agents, and stimulants.

On the outside of the inner container 3 as above, the outer container 4 is provided. The outer container 4 is also composed of a member having a bottomed tube-like shape.

A bottom portion of the outer container 4 is formed with a through-hole 41 in a substantially central part thereof. A stepped part 42 having an outside diameter varied stepwise is formed in the surroundings on an upper end side of the through-hole 41. A part formed in this manner constitutes a second seal member placing part where the second seal member 49 as described later is provided.

In addition, at an upper end surface of the bottom portion of the outer container 4, an annular fixing part 43 is projectingly formed concentrically with the through-hole 41. The lower member 31 of the inner container 3 is fitted and fixed in the fixing part 43. This configuration ensures that the center axis of the through-hole 41 and the center axis of the through-hole 311 coincide with each other, and the through-hole 41 and the through-hole 311 communicate with each other. The through-hole 41 and the through-hole 311 constitute a second opening.

The second seal member 49 having a circular disk-like shape is provided in the manner of sealing off the through-hole 41. The second seal member 49 is so disposed that its thickness direction coincides with the axial direction of the first container 2. This ensures that the second seal member 49 is easily and assuredly punctured by a needle tip 711 of the needle tube 71 constituting the communicating means 7.

Besides, the second seal member 49 is an elastic body which is thicker at its central portion than at its peripheral portion. The central portion is a portion to be punctured by the needle tube 71. The peripheral portion is clamped between the inner container 3 and the outer container 4, at the stepped part 42. This ensures that the second seal member 49 is assuredly fixed to the first container 2 and can be moved together with the first container 2.

In a natural state where no external force is applied, the central portion of the second seal member 49 has its lower end surface 491 in a protuberant form, projecting to below the bottom portion of the outer container 4.

Incidentally, a material constituting the second seal member 49 is not specifically restricted. For instance, the same elastic materials as those mentioned above as examples of the material for the valve element 33 can be used.

Below the first container 2, the second container 6 is provided coaxially with the first container 2. The second container 6 is provided with: a container body (second container body) 61; the communicating means 7 provided at a mouth part 612 of the container body 61; and a cover part 62 provided to be movable relative to the container body 61. The container body 61 and the communicating means 7 define an internal space (second space) 60, and the liquid 10 is stored in the internal space 60.

The container body 61 is composed of a member having a bottomed tube-like shape, and its trunk part 611 is bellows-like in shape. This permits the trunk part 611 to be extended and contracted. In other words, in the present embodiment, a volume of the internal space 60 is increased/decreased (can be varied) by the expansion/contraction of the trunk part 611.

In addition, the trunk part 611 is reduced in diameter at an upper end portion thereof, thereby constituting the mouth part 612. The cover part 62 is provided to be movable relative to the mouth part 612.

The cover part 62 includes a slide member 63 having a hollow cylindrical shape, and a third seal member 64 provided so as to seal off an upper end opening of the slide member 63.

The slide member 63 is reduced in diameter at an upper end part thereof. The part thus reduced in diameter constitutes a third seal member placing part where to place the third seal member 64.

The third seal member 64 is an elastic body having a circular disk-like shape and being thicker at its central portion than at its peripheral portion. The third seal member 64 has its peripheral portion clamped between the third seal member placing part and a clamp member 69. This ensures that the third seal member 64 is assuredly fixed to the slide member 63 and can be moved together with the slide member 63.

Besides, the third seal member 64 is so disposed that its thickness direction coincides with the axial direction of the second container 6. The third seal member 64 is to be punctured by the needle tip 711 of the needle tube 71, together with the second seal member 49 in close contact therewith.

Figure 2:
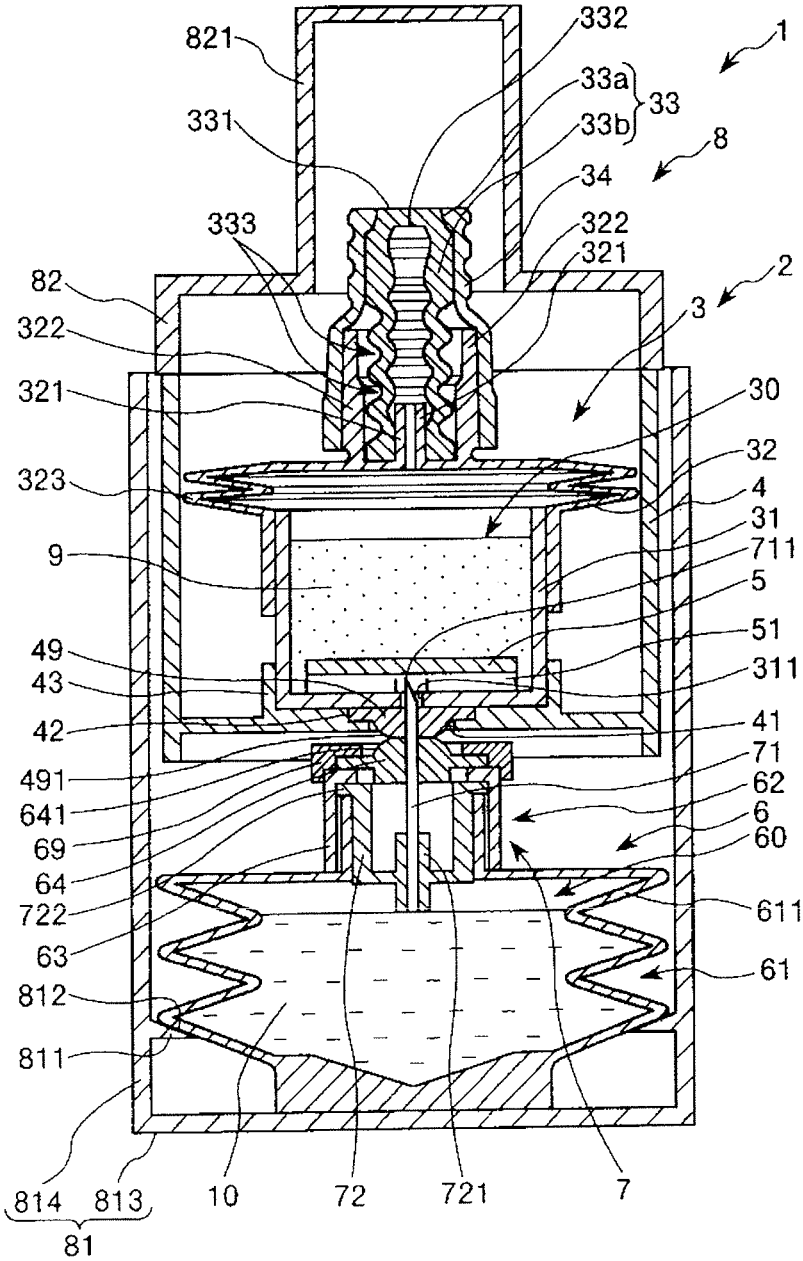
[FIG. 2]
Figure 3:
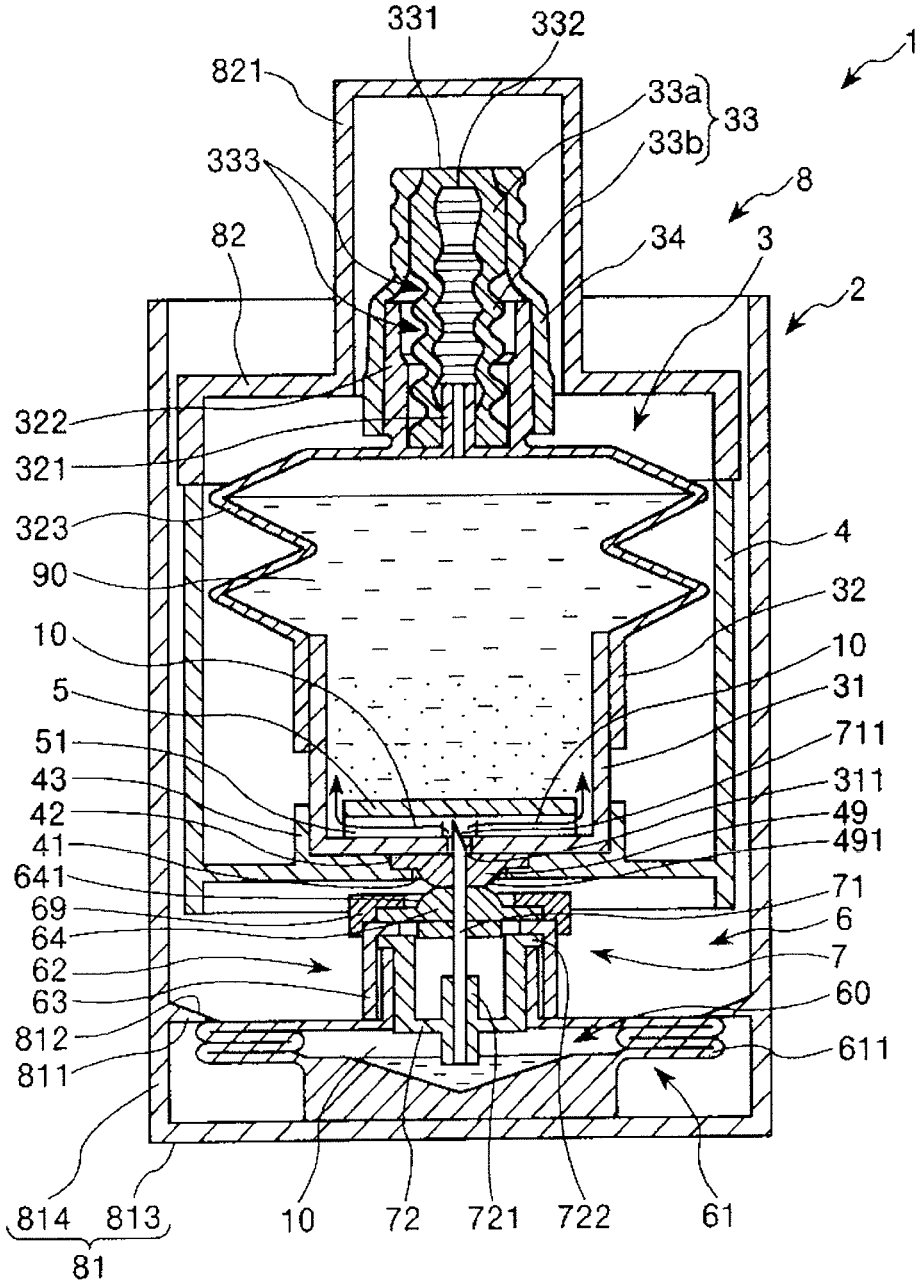
[FIG. 3]

In a natural state where no external force is exerted, the central portion of the third seal member 64 has its upper end surface 641 in a protuberant form. In a close-contact state wherein the second seal member 49 and the third seal member 64 are in close contact with each other as shown in FIGS. 1 to 3, the upper end surface 641 having been protuberant is flattened, like the lower end surface 491 of the second seal member 49. This ensures that the close-contact state is made to be more reliable, so that liquid-tightness can be secured at a boundary between the second seal member 49 and the third seal member 64.

Incidentally, a material constituting the third seal member 64 is not specifically restricted. For instance, the same elastic materials as those mentioned above as examples of the material for the valve element 33 can be used.

The liquid 10 stored in the internal space 60 of the second container 6 is used, for example, for dilution of the drug 9 in the case where the drug 9 is of a liquid type, or for dissolution of the drug 9 in the case where the drug 9 is of a powdery type.

The liquid 10 is not particularly restricted, so long as it is a liquid which can be injected in a mode of intravascular injection, intracutaneous injection, or subcutaneous injection. Examples of the liquid which can be used as the liquid 10 include physiological saline, dextrose in water, various Ringer solutions, water for injection, and electrolyte solutions.

With the internal space 60 and the internal space 30 made to communicate with each other through the communicating means 7, the liquid 10 is supplied to the drug 9, to be mixed with the drug 9. The product of the mixing is the drug solution 90.

As shown in FIGS. 1 to 3, the communicating means 7 is provided with: the needle tube 71 located at the mouth part 612 of the container body 61 and provided at its upper end with the needle tip 711 which is sharp; and a fixing part 72 for fixing the needle tube 71 to the second container 6 in a liquid-tight manner. Incidentally, in the present embodiment, an opening at the needle tip 711 of the needle tube 71 constitutes a third opening.

With the second seal member 49 and the third seal member 64 punctured by the needle tube 71, the internal space 60 and the internal space 30 communicate with each other through a lumen of the needle tube 71. Thus, it suffices for the needle tube 71 to have such a level of strength as to be able to puncture the second seal member 49 and the third seal member 64. A material constituting the needle tube 71 is not specifically restricted. Examples of the material which can be used include metallic materials such as stainless steel, etc., and rigid resin materials.

The fixing part 72 is composed of a member having a bottomed tube-like shape, and its bottom portion is provided at a central part thereof with a hub part 721 penetrating the bottom portion. A lower end portion of the needle tube 71 is inserted in and fixed to a lumen of the hub part 721.

In addition, the fixing part 72 is formed at its upper end portion with a flange 722 projecting outward. In a state in which the fixing part 72 is inserted in the mouth part 612 of the container body 61, the flange 722 makes contact with an upper end of the mouth part 612 and is fixed to the mouth part 612 by such a method as fitting, welding (thermal welding, high-frequency welding, ultrasonic welding or the like) and adhesion (adhesion with an adhesive or a solvent). This ensures that the needle tube 71 is positioned relative to the container body 61.

When the liquid 10 is stored in the internal space 60 of the container body 61 and the cover part 62 is mounted to the container body 61, as shown in FIG. 1, the needle tip 711 of the needle tube 71 punctures a lower end surface of the third seal member 64 and is located in the third seal member 64. This results in that the opening of the needle tip 711 as the third opening is sealed off by the third seal member 64. Further, in a state in which the first container 2 is disposed on an upper side of the second container 6, the second seal member 49 and the third seal member 64 are in close contact with each other. Hereinafter, this state shown in FIG. 1 will be referred to as "an initial state".

Besides, the drug storage container 1 in the present embodiment is provided with the operating means 8 for performing an operation of bringing the first container 2, which is in the initial state, closer to the second container 6.

With the operating means 8 operated, the first container 2 is brought closer to the second container 6, resulting in that the internal space 30 of the first container 2 and the internal space 60 of the second container 6 communicate with each other through the lumen of the needle tube 71, as shown in FIGS. 2 and 3. This ensures that the liquid 10 can be supplied to the drug 9. Hereinafter, this state shown in FIGS. 2 and 3 will be referred to as "a communicating state".

The operating means 8 includes: a guide part 81 for guiding the approach (movement) of the first container 2 toward the second container 6 while preventing the axis of the first container 2 and the axis of the second container 6 from coming out of alignment, at the time of performing the operation of bringing the first container 2 closer to the second container 6; and an operating part 82 for performing this operation.

The guide part 81 has a bottom part 813 and a tubular trunk part 814. In addition, the bottom part 813 has at a lower end thereof a flat surface orthogonal to the axial direction of the trunk part 814 (the vertical direction). This ensures that the drug storage container 1 can be stably mounted on a workbench and that a pressing operation of the operating part 82 can be carried out by one hand, as will be described later. Incidentally, while an outside diameter of the flat surface is substantially the same as an outside diameter of the trunk part 814 in the present embodiment, it may be larger than the outside diameter of the trunk part 814. The first container 2 and the second container 6 are stored inside the guide part 81, and a bottom portion of the container body 61 of the second container 6 is fixed to an upper end surface of a bottom portion of the guide part 81.

Incidentally, an inside diameter of the guide part 81 is set to be slightly greater than an outside diameter of the outer container 4 of the first container 2 and a maximum outside diameter of the container body 61 of the second container 6. This ensures that the axial of the first container 2 and the axis of the second container 6 can be prevented from coming out of alignment at the time of performing the operation of bringing the first container 2 closer to the second container 6, so that the operation can be carried out easily and reliably.

Besides, at an inner circumferential surface of the guide part 81, a projection 811 is formed, which maintains a contracted state of the bellows-like trunk part 611 of the container body 61 by engaging with the trunk part 611 when the trunk part 611 is contracted (see FIG. 3). An upper surface 812 of the projection 811 is inclined relative to the contracting direction of the trunk part 611. This permits the trunk part 611 to easily come over the projection 811 at the time of contracting.

On the other hand, the operating part 82 is also composed of a member having a bottomed tube-like shape, and its lower end can be fixed to the upper end of an outer container 4 of the first container 2 by, for example, fitting or engagement through engaging means (not shown).

In addition, a bottom portion of the operating part 82 is located above the tubular trunk part, and the bottom portion is formed at a central part thereof with a relief part 821 projecting upward. As will be described later, the valve element 33 and members surrounding the same are located inside the relief part 821 (see FIG. 3) when the liquid 10 flows into the internal space 30 of the first container 2 and the volume of the internal space 30 is thereby increased, in the communicating state.

Each of the components of the first container 2, the second container 6, the communicating means 7 and the operating means 8 (exclusive of the valve element 33, the second seal member 49, the third seal member 64 and the needle tube 71) is preferably provided with gas barrier properties and substantially transparent for securing visibility of the inside thereof. Examples of materials constituting these components include various resins such as polyvinyl chloride, polyethylene, polypropylene, cyclic polyolefins, polystyrene, poly(4-methylpentene-1), polycarbonate, acrylic resins, an acrylonitrile-butadiene-styrene copolymer, polyesters such as polyethylene terephthalate, polyethylene naphthalate, etc., a butadiene-styrene copolymer, and polyamides (e.g., nylon 6, nylon 6,6, nylon 6,10, nylon 12). Among these materials, preferred are such resins as polypropylene, cyclic polyolefins, polyesters, and poly(4-methylpentene-1) in view of their easy moldability.

In the drug storage container 1, in the communicating state, the liquid 10 is supplied to the drug 9 from below, to prepare the drug solution 90.

Here, if the liquid 10 is caused to drip onto the drug 9 from above to thereby prepare the drug solution 90 as in the past, foaming of the drug solution 90 is liable to occur. In the case of the drug solution 90 in which the foaming has occurred, it is difficult to dispense an accurate amount of the drug solution 90 into the syringe 100. Besides, in the case where the drug 9 is, for example, a protein having an activity, the foaming of the drug solution 90 may lead to disappearance of or a lowering in the activity.

In the drug storage container 1, on the other hand, the liquid 10 is supplied directly to the drug 9 from below the drug 9, so that the foaming is not liable to occur in the drug solution 90 obtained. Thus, the above-mentioned inconvenience can be prevented from being generated.

In the present embodiment, furthermore, the changing plate 5 is provided in the internal space 30 as above-mentioned, so that the following operations and effects can also be obtained.

Now, the configuration, the operations and effects of the changing plate 5 will be described below.

The changing plate 5 is composed of a member having a circular disk-like shape, and is fixed to an upper end surface of a bottom portion of the first container 2 (the lower member 31) by such a method as fitting, engagement, welding (thermal welding, high-frequency welding, ultrasonic welding or the like) and adhesion (adhesion with an adhesive or a solvent). As shown in FIG. 5, at a lower-side portion of the changing plate 5, a plurality of (in the configuration shown, four) flow paths 51 are formed to ranges from a central portion toward an outer side. The flow paths 51 join one another in a central area of the changing plate 5.

The liquid 10 flowing from the internal space 60 of the second container 6 into the internal space 30 of the first container 2 through the needle tube 71 in the communicating state, as shown in FIG. 3, impinges on the changing plate 5, whereby the flow direction of the liquid 10 is changed to directions (orthogonal directions) in a plane substantially orthogonal to the vertical direction. This ensures that the liquid 10 discharged from the needle tube 71 is not supplied directly to the drug 9 but is supplied gently to the drug 9 via a plurality of parts on the inner circumferential surface side of the lower member 31 of the inner container 3. Therefore, the drug 9 and the liquid 10 can be mixed with each other more assuredly and uniformly. In addition, the preventive effect on the foaming in the drug solution 90 obtained can be further enhanced. Such an effect is more conspicuous in the case where the drug 9 is of a powdery type.

Besides, in the present embodiment, each of the flow paths 51 has a width continuously enlarged along the outward direction, and is therefore sector-shaped in plan view. This ensures that the liquid 10 changed in flow direction by the changing plate 5 spreads radially along a bottom portion of the inner container 3 (the lower member 31). Therefore, the drug 9 and the liquid 10 can be mixed with each other further assuredly and uniformly. In addition, the liquid 10 passing through each of the flow paths 51 is gradually lowered in flow velocity, which promises gentler supply of the liquid 10 to the drug 9.

Incidentally, a material constituting the changing plate 5 is not specifically restricted. For instance, the same materials as those mentioned above as examples of the materials for the components of the first container 2 and the like can be used.

The drug storage container 1 as above-described can be used, for example, in the following manner.

[1] First, the drug storage container 1 in the initial state as shown in FIG. 1 is taken out of a package (not shown). Incidentally, a configuration may be adopted in which the first container 2, the second container 6, the communicating means 7 and the operating means 8 are individually stored in packages, and they are taken out of the packages and assembled to form the drug storage container 1 in the initial state when put to use.

[2] Next, the drug storage container 1 is mounted on a workbench, with the second container 6 on a lower side.

[3] In this condition, the operating part 82 is pressed downward by one hand, to move the first container 2 downward. In other words, the first container 2 is brought closer to the second container 6. Incidentally, in this instance, the drug storage container 1 can be stably mounted on the workbench owing to the guide part 81, as above-mentioned, so that the operation of pressing the operating part 82 can be carried out by one hand.

When the first container 2 is brought closer to the second container 6, a lower end portion of the first container 2 slides the cover part 62 of the second container 6 downward (toward the container body 61). As a result, the needle tip 711 of the needle tube 71 sequentially punctures the third seal member 64 and the second seal member 49, and thereafter reaches the internal space 30 of the first container 2 (the inside of the changing plate 5), establishing the communicating state shown in FIG. 2.

Besides, in this instance, a lower end of the cover part 62 (the slide member 63) makes contact with the container body 61.

[4] When the operating part 82 is further pressed downward to move the first container 2 downward, the container body 61 with the trunk part 611 in the bellows-like shape is pressed through the cover part 62, to be compressed gradually. Consequently, as the volume of the internal space 60 of the second container 6 is reduced, the liquid 10 is gradually pushed out through the lumen of the needle tube 71 toward the internal space 30 of the first container 2. Incidentally, the container body 61 thus compressed is engaged with the projection 811 of the guide part 81, whereby the compressed state thereof is maintained.

Thereafter, the liquid 10 flowing into the internal space 30 impinges on the changing plate 5, and flows in the flow paths 51, to make contact with and be mixed with the drug 9. Thus, with the flow direction of the liquid 10 changed into the orthogonal directions by the changing plate 5, the liquid 10 discharged from the needle tube 71 is not supplied directly to the drug 9, so that foaming of the drug solution 90 obtained can be prevented from occurring.

In this instance, as the liquid 10 flows into the internal space 30, the bellows-like trunk part 323 extends, so that the volume of the internal space 30 is increased by a value corresponding to the amount of the liquid 10 having flowed in. This restrains the pressure inside the internal space 30 from rising, so that the liquid 10 is prevented from flowing back from the internal space 30 into the internal space 60.

Besides, in this instance, variations in the external shape of the inner container 3 toward the outside are being restricted by the outer container 4, and variations in the external shape of the second container 6 toward the outside are being restricted by the guide part 81 of the operating means 8. Therefore, of the inner container 3 and the second container 6, the bellows-like parts can favorably deform without bending relative to the axial direction of the inner container 3, at the time of the expansion/contraction. Consequently, the expansion/contraction can take place assuredly.

[5] The operating part 82 is further pressed downward, to move the first container 2 downward, thereby putting the container body 61 into a most contracted state, as shown in FIG. 3. This ensures that the liquid 10 stored in the internal space 60 of the second container 6 can be substantially entirely transferred into the internal space 30 of the first container 2.

In the above-mentioned manner, the drug 9 and the liquid 10 are mixed with each other, whereby the drug solution 90 is prepared. With the drug 9 and the liquid 10 mixed in this way, the drug 9 and the liquid 10 can be mixed assuredly and uniformly, while preventing foaming from occurring in the drug solution 90.

[6] Next, the first container 2 in the state wherein the operating part 82 is fixed is taken out of the guide part 81. This results in that the needle tube 71 is drawn out of the second seal member 49, and the communication between the internal space 30 of the first container 2 and the internal space 60 of the second container 6 is released.

In this instance, of the second seal member 49, the part having been punctured by the needle tube 71 is closed by a self-closing property thereof.

[7] Then, the operating part 82 is detached from the first container 2, after which the mouth part 101 of the syringe 100 is connected to the valve element 33 of the first container 2, as shown in FIG. 4. Thereafter, a pusher 102 is operated to dispense a predetermined amount of the drug solution 90 into the syringe 100. In this instance, since foaming in the drug solution 90 is prevented, the predetermined amount of the drug solution 90 can be dispensed into the syringe 100 accurately and securely.

In addition, as the drug solution 90 flows into the syringe 100, the bellows-like trunk part 323 contracts. Therefore, the pressure inside the internal space 30 is restrained from being lowered, so that the predetermined amount of the drug solution 90 can be dispensed into the syringe 100 accurately and easily. Furthermore, as above-mentioned, a rise in the pressure inside the internal space 30 is being restrained by the extension of the bellows-like trunk part 323. This ensures that when the syringe 100 is connected to the first container 2, the drug solution 90 can be inhibited from gushing out from the valve element 33.

Besides, in the drug storage container 1 as above, the changing plate 5 may be configured as shown in FIG. 6. In the changing plate 5 shown in FIG. 6, each of flow paths 51 has a width substantially constant along the direction from the center toward the outside of the changing plate 5, but it is, as a whole, spirally curved in the circumferential direction of the changing plate 5.

This configuration permits the liquid 10 having flowed into the internal space 30 to be supplied to the drug 9 in the manner of vortex. Specifically, the liquid 10 having flowed into the internal space 30 can be whirled along the circumferential direction of the inner circumferential surface of the lower member 31 of the first container 2. This permits the drug 9 and the liquid 10 to be mixed with each other more speedily and uniformly.

Incidentally, a configuration may be adopted in which the flow paths 51 are not curved as a whole but its peripheral edge portion is curved or bent.

In addition, the flow paths 51 may be configured to have a part whose width decreases along the direction toward the peripheral edge portion. This permits the above-mentioned whirling to be generated efficiently.

Furthermore, in the drug storage container 1 as above, changing parts 5' configured as shown in FIGS. 7 to 9 may be adopted in place of the changing plates 5 as shown in FIGS. 5 and 6.

The changing part 5' shown in FIG. 7 is composed of: an annular projected part 52 provided at the upper end surface of the bottom portion of the lower member 31 of the first container 2 so as to surround the upper end opening of the through-hole 311; and a cap 53 provided so as to cover the projected part 52.

The cap 53 is composed of a member having a bottomed tube-like shape, and is formed with a plurality of cutouts 531 along a lower end edge portion thereof. The cap 53 is fixed to the upper end surface of the bottom portion of the lower member 31 by, for example, such a method as fitting, engagement, welding (thermal welding, high-frequency welding, ultrasonic welding or the like), adhesion (adhesion with an adhesive or a solvent), etc.

In the changing part 5' configured in this way, the bottom portion of the cap 53 is located above a tubular trunk portion, and the liquid 10 having flowed out from the projected part 52 impinges on a lower end surface of a bottom portion of the cap 53, whereby the flow direction is changed to directions substantially orthogonal to the vertical direction, and the liquid 10 flows out through the cutouts 531. In other words, the liquid 10 flows radially into the internal space 30.

The changing part 5' shown in FIG. 8 is so configured that an inside diameter of a trunk portion of a cap 53 is set to be slightly smaller than an outside diameter of a projected part 52, and the cap 53 is fixed to the projected part 52 by fitting.

In addition, the trunk portion of the cap 53 is formed with a plurality of through-holes 532 arranged along the circumferential direction, at such positions as not to interfere with the projected part 52 when the cap 53 is fixed to the projected part 52.

The changing part 5' shown in FIG. 9 is composed of: the above-mentioned changing plate 5; and a circular disk-shaped elastic plate 54 provided on a lower end side relative to the changing plate 5.

Besides, the inner circumferential surface of the lower member 31 of the first container 2 is formed at a vertical-directionally intermediate portion thereof with a plurality of (for example, four) projection pieces 312 projecting inward. The spacing between each of the projection pieces 312 and the upper end surface of the bottom portion of the lower member 31 is set to be slightly smaller than the total thickness of the changing plate 5 and the elastic plate 54.

In the condition wherein the changing plate 5 and the elastic plate 54 are stacked, each of their edge portions is inserted between each of the projection pieces 312 and the bottom portion of the lower member 31, whereby the changing part 5' is fixed to the first container 2.

The flow paths 51 may be provided not on the changing plate 5 but at the upper end surface of the elastic plate 54, or may be provided on both the changing plate 5 and the elastic plate 54.

Incidentally, the elastic plate 54 has a through-hole 541 formed in a central portion thereof, and is so arranged that the center axis of the through-hole 541, the center axis of the through-hole 311 in the lower member 31 and the center axis of the changing plate 5 coincide with one another.

According to the configuration as above, the elastic plate 54 makes close contact with the changing plate 5 and the upper end surface of the bottom portion of the lower member 31, so that the flow paths 51 formed on the changing plate 5 can be held assuredly.

Incidentally, a material constituting the elastic plate 54 is not specifically restricted. For instance, the same materials as those mentioned above as examples of the material for the valve element 33 can be used.

Second Embodiment

Figure 10:
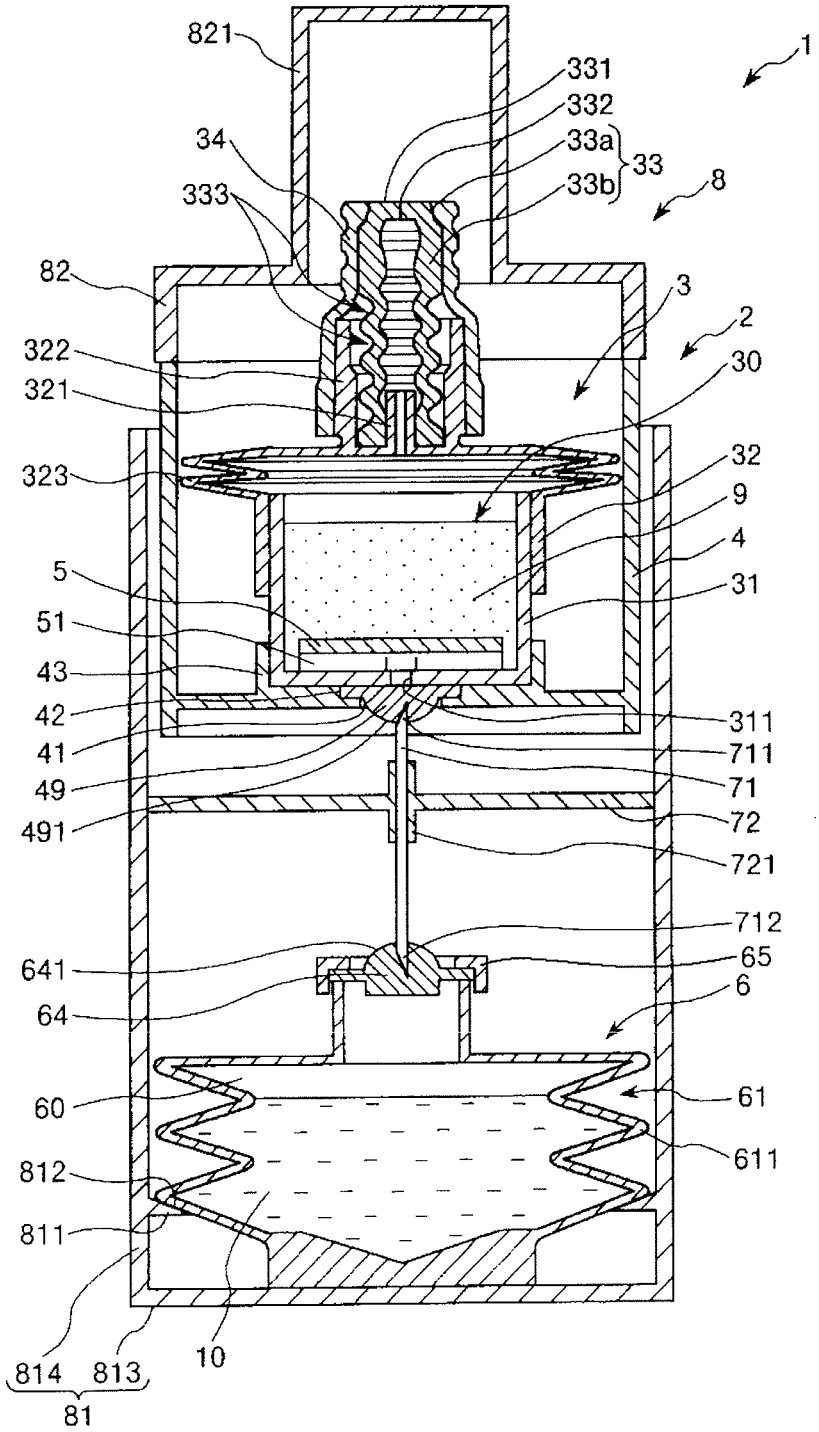
[FIG. 10]

FIG. 10 is a longitudinal sectional view showing a drug storage container (second embodiment) of the present invention.

Now, the second embodiment of the drug storage container according to the present invention will be described below, referring to this figure. The following description will be focused on the differences from the above-described first embodiment, and descriptions of the same items as above will be omitted.

The drug storage container 1 according to the second embodiment shown in FIG. 10 is the same as the drug storage container 1 according to the first embodiment above, except that the communicating means 7 is not provided in the second container 6.

The communicating means 7 in the second embodiment includes: a needle tube 71 provided with a sharp needle tip 711 at an upper end thereof and with a sharp needle tip 712 at a lower end thereof; and a circular disk-shaped fixing part 72 for fixing the needle tube 71 to a guide part 81 of operating means 8.

Incidentally, the fixing part 72 is fixed to the guide part 81 by, for example, such a method as light fitting, partial welding (thermal welding, high-frequency welding, ultrasonic welding or the like), adhesion (adhesion with an adhesive or a solvent), etc.

Besides, in the second container 6, an upper end opening of a mouth part 612 of a container body 61 constitutes a third opening, and a third seal member 64 is provided so as to seal off the mouth part 612. In addition, the third seal member 64 is fixed by a tubular cap 65 fitted to the mouth part 612.

In the drug storage container 1 as above, in an initial state, the needle tip 711 of the needle tube 71 punctures a lower end surface 491 of a second seal member 49, to be located in an inside of the second seal member 49, whereas the needle tip 712 punctures an upper end surface 641 of the third seal member 64, to be located in an inside of the third seal member 64.

When the operating means 8 is operated to move the first container 2 downward, the needle tip 711 of the needle tube 71 pierces through the second seal member 49, while the needle tip 712 pierces through the third seal member 64, and a lower end portion of the first container 2 makes contact with the fixing part 72 of the communicating means 7, to move the needle tube 71 downward together with the fixing part 72. This results in a state in which an internal space 30 of the first container 2 and an internal space 60 of the second container 6 communicate with each other through a lumen of the needle tube 71.

In the drug storage container 1 of the second embodiment as above, also, the same or equivalent effects to those in the first embodiment above can be obtained.

Third Embodiment

Figure 11:
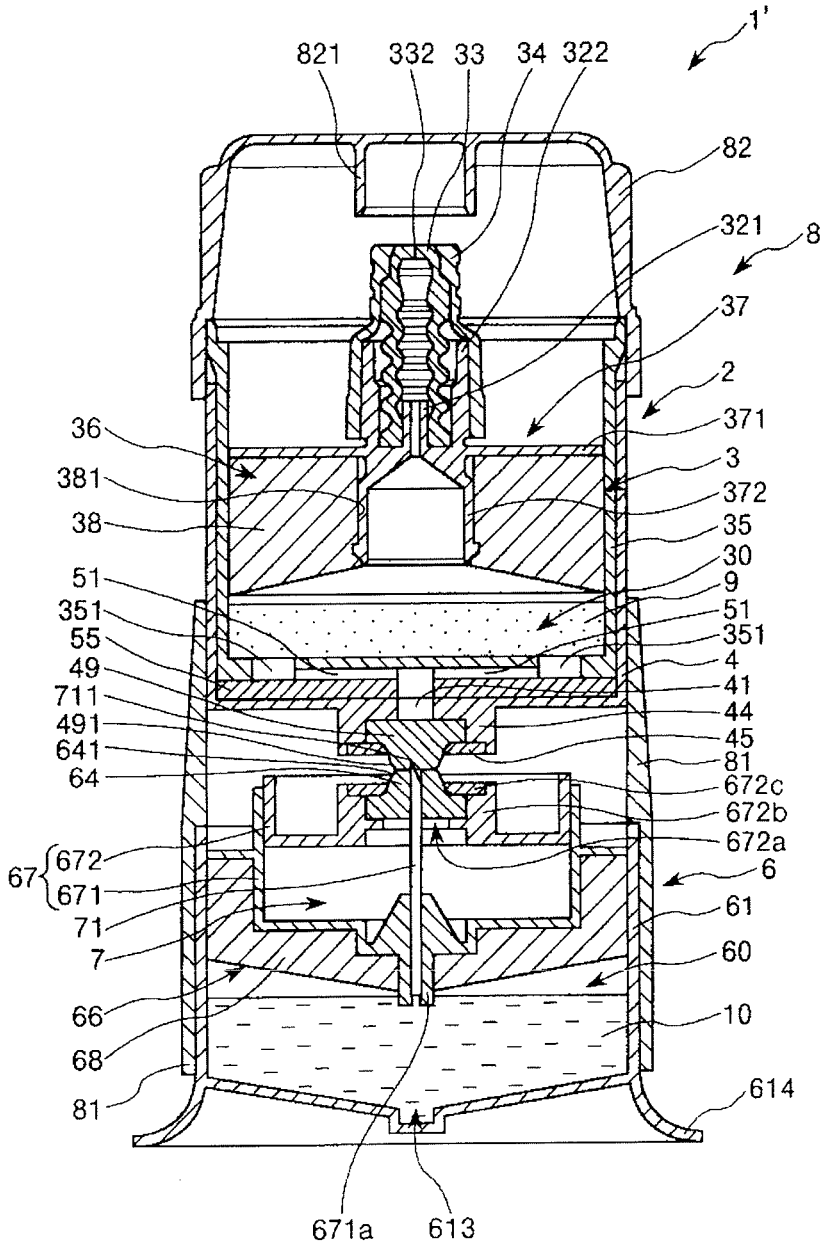
[FIG. 11]
Figure 12:
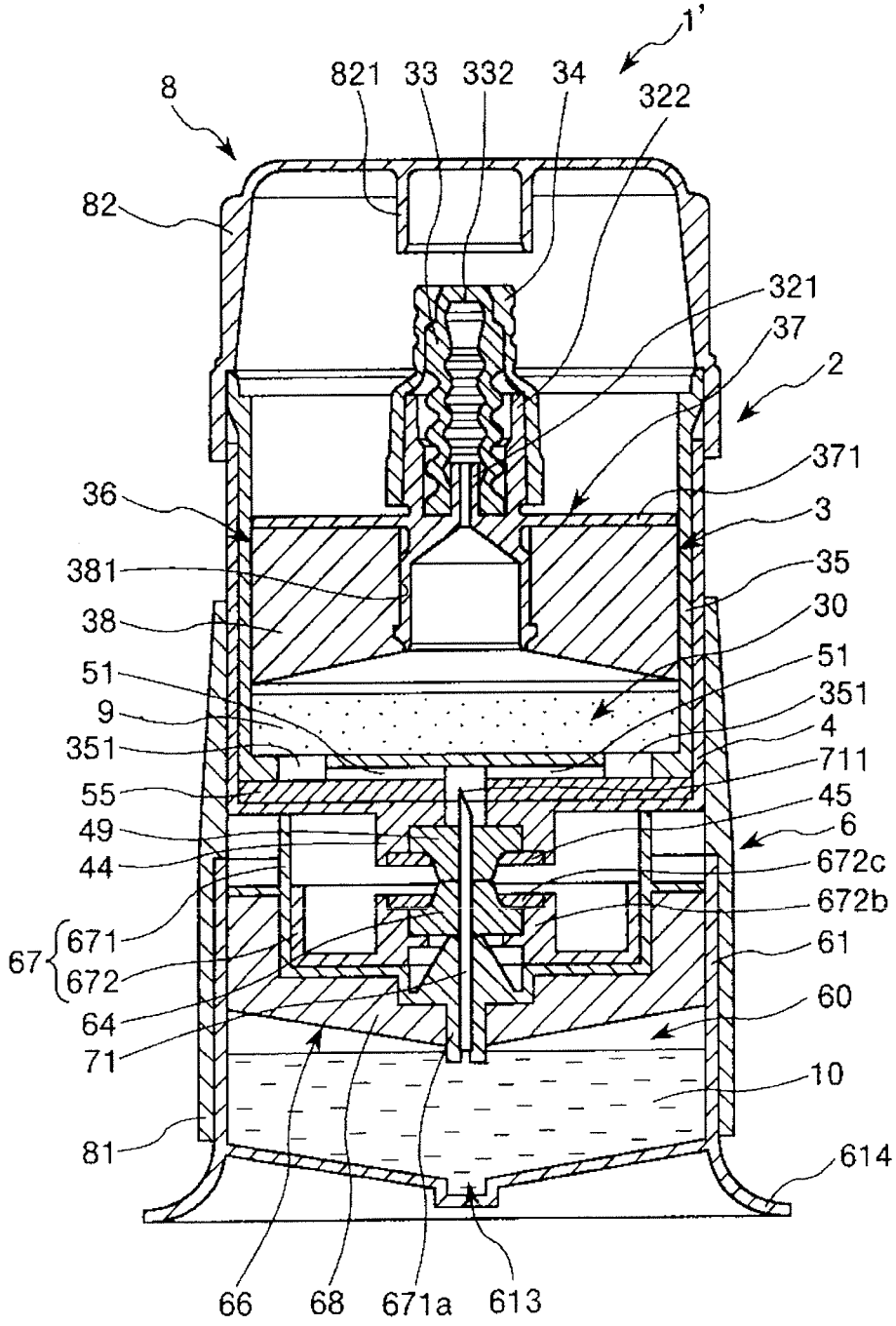
[FIG. 12]
Figure 13:
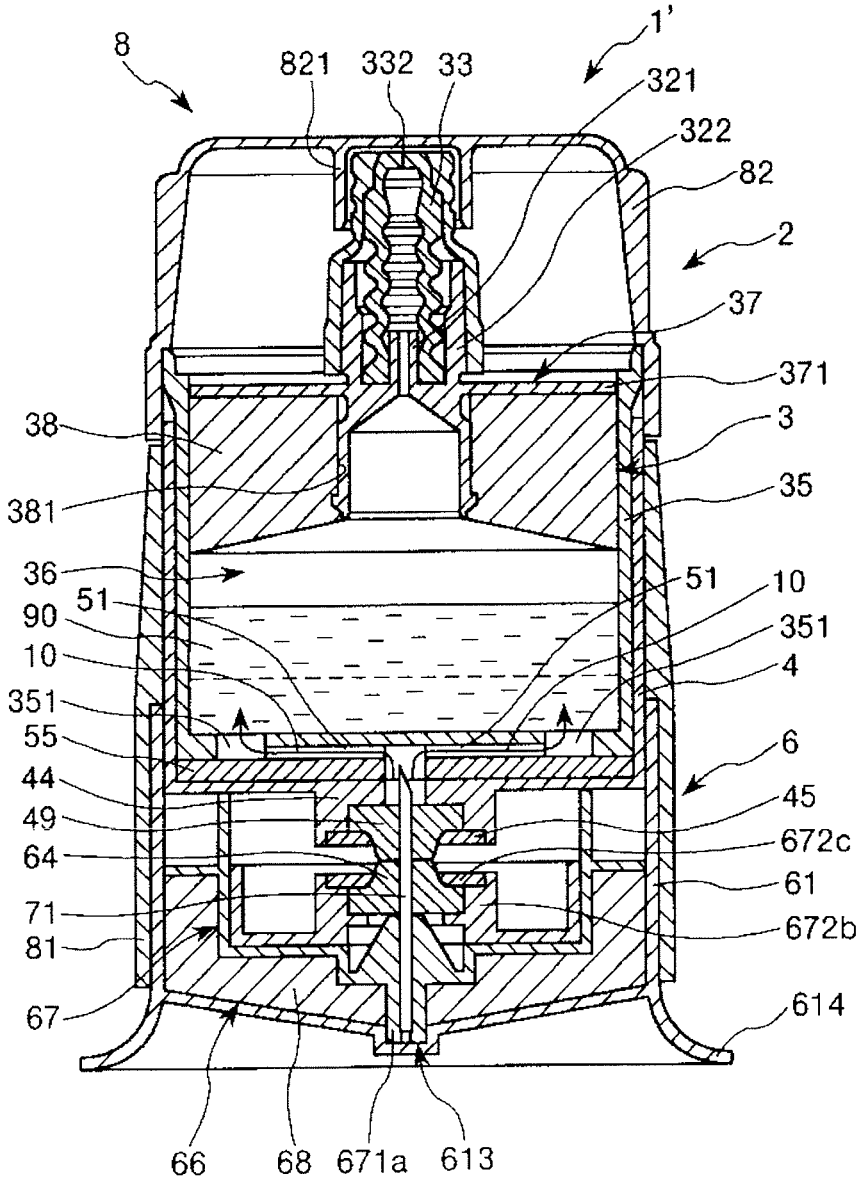
[FIG. 13]

Each of FIGS. 11 to 13 is a longitudinal sectional view for sequentially illustrating a process of using a drug storage container (third embodiment) of the present invention.

Now, the third embodiment of a drug storage container according to the present invention will be described below, referring to these figures. The following description will be focused on differences from the above-described first embodiment, and descriptions of the same items as above will be omitted.

A drug storage container 1' according to the third embodiment shown in FIGS. 11 to 13 is the same as the drug storage container 1 according to the first embodiment above, mainly except that a volume of an internal space 30 is effected by movement of a gasket 36 and a volume of an internal space 60 is effected by movement of a gasket 66.

An inner container 3 of a first container 2 includes: an outer tube member 35 having a bottomed tube-like shape; and the gasket 36 provided inside the outer tube member 35 so as to be slidable along the axial direction of the latter.

In the present embodiment, the internal space 30 for storing a drug 9 is defined by the outer tube member 35 and the gasket 36, and the volume of the internal space 30 is increased/decreased by an upward/downward slide of the gasket 36.

A bottom portion of the outer tube member 35 is formed with a plurality of through-holes 351 arranged along an outer circumferential portion thereof. Via the through-holes 351, a liquid 10 flows into the internal space 30.

As shown in FIGS. 11 to 13, the gasket 36 includes: a main body part 37 having a circular disk-shaped base part 371; and a contact part 38 fixed to the main body part 37 and making contact with an inner circumferential surface of the outer tube member 35.

At an upper end surface of the base part 371, an upwardly projecting mouth part 321 is formed in a central area thereof, and a circular tube-shaped support part 322 is formed concentrically with the mouth part 321. At this part, a valve element 33 is provided and is fixed by a cap 34, like in the first embodiment above.

On the other hand, at a lower end surface of the base part 371, a downwardly projecting, circular tube-shaped fitting part 372 is formed in a central area thereof. A lumen of the fitting part 372 communicates with the internal space 30 and a lumen of the mouth part 321.

The contact part 38 is composed of an elastic cylindrical member, which is formed with a through-hole 381 in a central portion thereof. The fitting part 372 of the main body part 37 is inserted and fitted in an upper-end-side portion of the through-hole 381, whereby the contact part 38 is fixed to the main body part 37. Incidentally, the fitting part 372 is formed with a claw part on a lower end side thereof, while the through-hole 381 is formed with a stepped part on the lower end side thereof. By engagement between the claw part and the stepped part, the contact part 38 is fixed to the main body part 37 more securely.

In addition, a lower-end-side portion of the through-hole 381 increases in diameter along the downward direction, and a lower end surface of the contact part 38 is conical in shape. This ensures that at the time of dispensing the drug solution 90 into the syringe 100, the drug solution 90 can be discharged from the internal space 30 without wasting it.

At a lower end surface of a bottom portion of the outer container 4, an annular part 44 is projectingly formed so as to surround a through-hole 41 constituting the second opening. A second seal member 49 disposed inside the annular part 44 is clamped between the bottom portion of the outer container 4 and an annular plate-shaped part 45, thereby being fixed to the outer container 4. The annular part 44 and the plate-shaped part 45 constitute a second seal member placing part.

Between the outer container 4 and the inner container 3 is disposed an annular elastic plate 55. A space is secured by the outer container 4, the inner container 3 and the elastic plate 55. In this space, flow paths 51 are formed by grooves or projections provided at a bottom portion of the inner container 3. The liquid 10 having flowed into this space impinges on a lower end surface of the bottom portion of the inner container 3, and its flow direction is changed into directions in a plane substantially orthogonal to the vertical direction so that the liquid 10 flows in the flow paths 51. In other words, in the present embodiment, the bottom portion of the inner container 3 and the elastic plate 55 constitute a changing part by which the flowing-in direction of the liquid 10 is changed. Incidentally, in the present embodiment, the space where the flow paths 51 are formed and the internal space 30 constitute a first space. Besides, the flow paths 51 may be configured by forming grooves or projections at an upper surface of the elastic plate 55, unlike in the configuration shown in FIGS. 11 to 13. In addition, the flow paths 51 may be configured by forming the grooves or the projections at the lower surface of the elastic plate 55 or at the bottom portion of the outer container 4. Besides, these configurations may be combined to thereby configure the flow paths 51. Further, the flow paths 51 may be configured by through-holes which are bored in the elastic plate 55 so as to provide communication between the through-hole 41 constituting the second opening and the through-holes 351.

A second container 6 includes: a container body 61 having a bottom portion and a tubular trunk portion; and a gasket 66 provided in the trunk portion of the container body 61 so as to be slidable along the axial direction of the latter (the vertical direction). In addition, a bottom portion 614 of the container body 61 is provided at a lower end thereof with a plain surface orthogonal to the axial direction of the trunk portion (vertical direction). This ensures that the drug storage container 1 can be stably mounted on a workbench, and, as will be described later, an operation of pressing an operating part 82 can be carried out by one hand. Incidentally, in the present embodiment, the trunk portion of the container body 61 increases in diameter along the direction toward the bottom portion (lower end) thereof, and an outside diameter of the plain surface of the bottom portion 614 is set to be greater than an outside diameter of a guide part 81. This permits the drug storage container 1 to be mounted more stably.

In the present embodiment, the internal space 60 in which to store the liquid 10 is defined by the container body 61 and the gasket 66, and the volume of the internal space 60 is increased/decreased by upward/downward movement of the gasket 66.

As shown in FIGS. 11 to 13, the gasket 66 includes: a main body part 67; and a contact part 68 fixed to the main body part 67 and making contact with an inner circumferential surface of the container body 61. Furthermore, the main body part 67 is composed of: a base part 671; and a slide part 672 provided inside the base part 671 so as to be slidable in the vertical direction.

The base part 671 includes: a first portion having a bottomed tube-like shape; and a flange-shaped second portion formed at a vertical-directionally intermediate portion of the first portion so as to project outward. The contact part 68 is fixed (attached) to that part of the first portion which is located below the second portion.

A bottom part of the first portion is provided at its central portion with a hub part 671*a* penetrating the bottom part. In a lumen of the hub part 671*a*, a needle tube 71 is inserted and fixed.

In addition, a lower end portion of the hub part 671*a* is protruding to a lower end side of the contact part 68 in a state in which the contact part 68 is mounted to the base part 671 (the main body part 67). This ensures that the lumen of the needle tube 71 communicates with the internal space 60.

Incidentally, an upper end surface of a bottom portion of the container body 61 is formed with a relief part 613 in which to store the lower end portion of the hub part 671*a*. This ensures that when the gasket 66 is set closest to the bottom portion of the container body 61, the lower end portion of the hub part 671*a* is located in the relief part 613, and a lower end surface of the contact part 68 makes close contact with the upper end surface of the bottom portion of the container body 61. In this instance, besides, the hub part 671*a* and the relief part 613 are fitted to or engaged with each other, whereby movement of the gasket 66 is restricted, and an increase in the volume of the second space (the internal space 60) is restrained (see FIG. 13). Furthermore, the hub part 671*a* and the relief part 613 may be formed with recesses and projections, or with projected portions, which are engaged with each other.

On the inside of the base part 671, the slide part 672 is supported in a movable manner. The slide part 672 is composed of a member having a bottomed tube-like shape, and its bottom portion is formed in a central part thereof with a through-hole 672*a* in which the needle tube 71 is to be inserted and passed. The needle tube 71 is inserted and passed in the through-hole 672*a*.

Besides, at an upper end surface of a bottom portion of the slide part 672, an annular part 672*b* is projectingly formed so as to surround the through-hole 672*a*. A third seal member 64 disposed on an inside of the annular part 672*b* is clamped between the bottom portion of the slide part 672 and an annular plate-shaped part 672*c*, thereby being fixed to the slide part 672.

The guide part 81 of the operating means 8 in the present embodiment is composed of a tubular member, of which a lower end portion is fixed by fitting to the container body 61 of the second container 6. In addition, the first container 2 is inserted in an upper-end-side portion of the guide part 81.

On the other hand, the operating part 82 is composed of a member having a bottomed tube-like shape, and its lower end can be fixed to an upper end of the inner container 3 of the first container 2 by, for example, fitting or engagement using engaging means (not shown).

In addition, a bottom portion of the operating part 82 is located above a tubular trunk portion, and the bottom portion is formed at a central part thereof with a relief part 821 projecting downward. As will be described later, when the liquid 10 flows into the internal space 30 of the first container 2 to increase the volume of the internal space 30, in a communicating state, upper end portions of the valve element 33 and the members surrounding it are located inside the relief part 821 (see FIG. 13).

Incidentally, materials constituting the outer tube member 35, the main body part 37 of the gasket 36, the plate-shaped part 45 and the main body part 67 of the gasket 66 are each not specifically restricted. For instance, the same materials as those mentioned above as examples of the materials for such parts as the first container 2 can be used.

In addition, materials constituting the contact part 38 of the gasket 36, the elastic plate 55 and the contact part 68 of the gasket 66 are each not specifically restricted. For instance, the same materials as those mentioned above as examples of the material for the valve element 33 in the first embodiment can be used.

The drug storage container 1' as above can be used, for example, in the following manner.

[1'] First, the drug storage container 1 in the initial state as shown in FIG. 11 is taken out of a package (not shown). Incidentally, a configuration may be adopted in which the first container 2, the second container 6, the communicating means 7 and the operating means 8 are individually stored in packages, and they are taken out of the packages and assembled to form the drug storage container 1 in the initial state when put to use.

In this initial state, the needle tip 711 of the needle tube 71 is puncturing the lower end surface of the third seal member 64, the opening of the needle tip 711 as the third opening is being sealed off by the third seal member 64, and the second seal member 49 and the third seal member 64 are in close contact with each other.

[2'] Next, the drug storage container 1' is mounted on a workbench, with the second container 6 on a lower side.

[3'] In this condition, the operating part 82 is pressed downward by one hand, to move the first container 2 downward. In other words, the first container 2 is brought closer to the second container 6. Incidentally, in this instance, the drug storage container 1 can be stably mounted on the workbench owing to the bottom portion of the second container 6, as above-mentioned, so that the operation of pressing the operating part 82 can be carried out by one hand.

When the first container 2 is brought closer to the second container 6, a lower end portion of the first container 2 slides the slide part 672 of the second container 6 downward. As a result, the needle tip 711 of the needle tube 71 sequentially punctures the third seal member 64 and the second seal member 49, and thereafter reaches the internal space 30 of the first container 2 (the inside of the elastic plate 55), establishing the communicating state shown in FIG. 12.

Besides, in this instance, a lower end of the first container 2 makes contact with an upper end of the base part 671 of the gasket 66.

[4'] When the operating part 82 is further pressed downward to move the first container 2 downward, the gasket 66 is pressed by the first container 2, to be gradually moved downward. Consequently, as the volume of the internal space 60 of the second container 6 is reduced, the liquid 10 is gradually pushed out through the lumen of the needle tube 71 toward the internal space 30 of the first container 2.

Thereafter, the liquid 10 flowing into the internal space 30 impinges on the bottom portion of the inner container 3, flows within the space between the inner container 3 and the outer container 4, and flows out via the through-hole 351, to make contact with and be mixed with the drug 9. Thus, with the flow direction of the liquid 10 changed into the orthogonal directions by the changing part 5' composed of the bottom portion of the inner container 3 and the elastic plate 55, the liquid 10 discharged from the needle tube 71 is not supplied directly to the drug 9, so that foaming of the drug solution 90 obtained can be prevented from occurring.

In this instance, as the liquid 10 flows into the internal space 30, the gasket 36 is moved upward, so that the volume of the internal space 30 is increased by a value corresponding to the amount of the liquid 10 having flowed in. This restrains the pressure inside the internal space 30 from rising, so that the liquid 10 is prevented from flowing back from the internal space 30 into the internal space 60.

[5'] Further, the operating part 82 is pressed downward, to move the first container 2 downward, thereby resulting in a state in which the lower end surface of the gasket 66 and the upper end surface of the bottom portion of the container body 61 are in close contact with each other, as shown in FIG. 13. This permits the liquid 10 stored in the internal space 60 of the second container 6 to be substantially wholly transferred into the internal space 30 of the first container 2. In addition, as above-mentioned, in this instance, the hub part 671*a* and the relief part 613 are fitted to or engaged with each other, whereby the movement of the gasket 66 is restricted, and an increase in the volume of the internal space 60 is restrained.

In the above-mentioned manner, the drug 9 and the liquid 10 are mixed with each other, and the drug solution 90 is prepared thereby. With the drug 9 and the liquid 10 mixed in this way, the drug 9 and the liquid 10 can be mixed assuredly and uniformly, while preventing foaming in the drug solution 90 from occurring.

[6'] Next, the first container 2 with the operating part 82 fixed is taken out of the guide part 81. As a result, the needle tube 71 is drawn out of the second seal member 49, and the communication between the internal space 30 of the first container 2 and the internal space 60 of the second container 6 is released.

In this instance, of the second seal member 49, the part having been punctured by the needle tube 71 is closed by a self-closing property thereof.

[7'] Subsequently, the operating part 82 is detached from the first container 2, after which a mouth part 101 of the syringe 100 is connected to the first container 2. Thereafter, a pusher 102 is operated to dispense a predetermined amount of the drug solution 90 into the syringe 100. In this instance, since foaming in the drug solution 90 is prevented from occurring, the predetermined amount of the drug solution 90 can be dispensed into the syringe 100 accurately and reliably. In addition, as the drug solution 90 flows into the syringe, a bellows-like trunk part 323 is contracted. Therefore, the pressure inside the internal space 30 is restrained from being lowered, and the predetermined amount of the drug solution 90 can be dispensed into the syringe 100 accurately and easily. Furthermore, as above-mentioned, the bellows-like trunk part 323 is extended, whereby a rise in the pressure inside the internal space 30 is suppressed. This ensures that when the syringe 100 is connected to the first container 2, the drug solution 90 can be inhibited from gushing out from the valve element 33.

In the drug storage container 1' according to the third embodiment as above, also, the same or equivalent operations and effects to those in the first embodiment above can be obtained.

While the embodiments shown in the drawings of the drug storage container according to the present invention have been described above, the invention is not to be restricted to the embodiments. The components of the drug storage container can be replaced by those of arbitrary configurations which can exhibit the same or equivalent functions to the above-mentioned. Besides, arbitrary structures may be added.

In addition, the drug storage container of the present invention may be a combination of arbitrary two or more configurations (features) of the above-described embodiments. For instance, the first container may be configured as in the first embodiment, and the second container as in the third embodiment. Or, alternatively, the first container may be configured as in the third embodiment, and the second container as in the first embodiment.

Besides, in the first embodiment, as the contraction maintaining means for maintaining contracted state of the bellows-like trunk part, the same or equivalent configuration to the fitting or engagement between the hub part and the relief part in the third embodiment can be employed.

INDUSTRIAL APPLICABILITY

The drug storage container according to the present invention includes: the first container which includes the first container body including the first opening provided at the upper end, the second opening provided at the lower end, the first space having a variable volume, and the drug stored in the first space, the first seal member so provided as to close the first opening in a liquid-tight manner, and the second seal member for sealing the second opening; the second container which is used while disposed on the lower side as compared with the first container, and which includes the second container body including the third opening provided at the upper end, the second space having a variable volume, and the liquid stored in the second space, and the third seal member for sealing the third opening; the hollow needle tube which is located between the first space and the second space, and which pierces through the second seal member and the third seal member to establish a communication between the first space and the second space when the first container and the second container are brought closer to each other; and the changing part which is provided inside the first space on the upper end side as compared with the second seal member, and which brings the first container and the second container closer to each other so as to make the first space and the second space communicate with each other through the needle tube and so as to reduce the volume of the second space, thereby changing the flow direction of the liquid so that the liquid discharged from the needle tube is not supplied directly to the drug when the liquid flows from the second space into the first space.

This ensures that at the time when the liquid and the drug stored in the storing space are mixed with each other in the connected state, the liquid is supplied toward the drug from below. Therefore, the liquid and the drug are mixed efficiently, specifically, easily and speedily, while preventing or preventing foaming from occurring in the drug solution obtained. Accordingly, the drug is dissolved or dispersed in the liquid uniformly (homogeneously), and accurate metering of the drug solution can be achieved. Thus, the drug storage container of the present invention has industrial applicability.

The invention claimed is:

1. A drug storage container characterized by comprising:

a first container which includes a first container body including a first opening provided at an upper end, a second opening provided at a lower end, a first space having a variable volume, and a drug stored in the first space, a first seal member so provided as to close the first opening in a liquid-tight manner, and a second seal member for sealing the second opening;

a second container which is used while disposed on a lower side as compared with the first container, and wherein the second container includes a second container body including a third opening provided at an upper end, a second space having a variable volume, and a liquid stored in the second space, and a third seal member for sealing the third opening;

a hollow needle tube which is located between the first space and the second space, and wherein the hollow needle tube pierces through the second seal member and the third seal member to establish a communication between the first space and the second space when the first container and the second container are brought closer to each other; and a changing part which is provided inside the first space on an upper end side as compared with the second seal member and changes a flow direction of the liquid so that the liquid discharged from the needle tube is not supplied directly to the drug, wherein the first space and the second space communicate with each other through the needle tube to reduce a volume of the second space by bringing the first container and the second container closer to each other, so that the liquid flows from the second space into the first space through the needle tube and the flow direction of the liquid flowing into the first space is changed not to be supplied directly to the drug due to the changing part.

2. The drug storage container according to claim 1, wherein the changing part changes the flow direction of the liquid into an orthogonal direction which is substantially orthogonal to a vertical direction.

3. The drug storage container according to claim 2, wherein the changing part has a flow path formed along the orthogonal direction.

4. The drug storage container according to claim 3, wherein the flow path has a portion which is curved or bent spirally in a circumferential direction of the changing part.

5. The drug storage container according to claim 1, wherein the first container body has a tubular trunk part, and the trunk part is so configured that at least a part thereof can be extended and contracted along a vertical direction, whereby the volume of the first space can be varied.

6. The drug storage container according to claim 1, wherein the first container body has a tubular trunk part, and the first container has a gasket provided in the trunk part in a slidable manner, whereby the volume of the first space can be varied.

7. The drug storage container according to claim 1, wherein the second container body has a tubular trunk part, and the trunk part is so configured that at least a part thereof can be extended and contracted along a vertical direction, whereby the volume of the second space can be varied.

8. The drug storage container according to claim 1, wherein the second container body has a tubular trunk part, and the second container has a gasket provided in the trunk part in a slidable manner, whereby the volume of the second space can be varied.

9. The drug storage container according to claim 1, further comprising operating means for performing an operation of bringing the first container closer to the second container.

* * * * *